US012709893B2

(12) United States Patent
Pszczonka

(10) Patent No.: US 12,709,893 B2
(45) **Date of Patent: *Aug. 18, 2026**

(54) FORMWORK

(71) Applicant: Rise Form Pty Ltd., Brisbane (AU)

(72) Inventor: Daniel Pszczonka, Sydney (AU)

(73) Assignee: Rise Form Pty Ltd., Brisbane (AU)

( * ) Notice: Subject to any disclaimer, the term of this patent is extended or adjusted under 35 U.S.C. 154(b) by 58 days.

This patent is subject to a terminal disclaimer.

(21) Appl. No.: 18/596,379

(22) Filed: Mar. 5, 2024

(65) Prior Publication Data

US 2024/0254764 A1 Aug. 1, 2024

Related U.S. Application Data

(63) Continuation of application No. 17/963,811, filed on Oct. 11, 2022, now Pat. No. 11,920,345, which is a (Continued)

(30) Foreign Application Priority Data

Sep. 1, 2016 (AU) ..... 2016903502

(51) Int. Cl.
*E04B 2/86* (2006.01)
*E04G 9/05* (2006.01)
(Continued)

(52) U.S. Cl.
CPC ..... *E04B 2/8641* (2013.01); *E04G 9/05* (2013.01); *E04G 9/083* (2013.01); *E04G 9/10* (2013.01);
(Continued)

(58) Field of Classification Search
CPC ..... E04B 2/8641; E04B 2002/8676; E04B 2002/8694; E04B 2/8617; E04B 2/8635;
(Continued)

(56) References Cited

U.S. PATENT DOCUMENTS 3,481,093 A 12/1969 Davidson
3,559,355 A 2/1971 Day, Jr.
(Continued)

FOREIGN PATENT DOCUMENTS

CA 2367664 11/2000
CA 2302972 9/2001
(Continued)

OTHER PUBLICATIONS

IP Australia, "International-Type Search Report," issued in connection with Application No. 2016903502, Nov. 30, 2016, 10 pages.
(Continued)

*Primary Examiner* — Patrick J Maestri
(74) *Attorney, Agent, or Firm* — McDonnell Boehnen Hulbert & Berghoff LLP

(57) ABSTRACT

A collapsible formwork element, the element including: a pair of opposing side wall panels; and at least one connector member extending between the side wall panels, wherein the formwork element is movable between an expanded configuration, wherein the opposing panels are spaced apart, and a collapsed configuration, wherein the opposing panels are relatively closer together.

20 Claims, 19 Drawing Sheets

Related U.S. Application Data continuation of application No. 16/328,641, filed as application No. PCT/AU2017/050938 on Sep. 1, 2017, now Pat. No. 11,466,452.

(51) Int. Cl.
*E04G 9/08* (2006.01)
*E04G 9/10* (2006.01)
*E04G 17/075* (2006.01)

(52) U.S. Cl.
CPC .. *E04G 17/0754* (2013.01); *E04B 2002/8676* (2013.01)

(58) Field of Classification Search
CPC .. E04G 9/05; E04G 9/083; E04G 9/10; E04G 17/0754
See application file for complete search history.

(56) References Cited

U.S. PATENT DOCUMENTS

| | | | |
|---|---|---|---|
| 3,886,751 | A | 6/1975 | Labora |
| 3,985,329 | A | 10/1976 | Liedgens |
| 5,323,578 | A | 6/1994 | Chagnon |
| 6,067,764 | A | 5/2000 | Johansen |
| 6,230,462 | B1 | 5/2001 | Béliveau |
| 6,915,613 | B2 | 7/2005 | Wostal et al. |
| 8,468,761 | B2 | 6/2013 | Marshall |
| 8,479,469 | B2 | 7/2013 | Ciccarelli |
| 9,206,614 | B2 | 12/2015 | Richardson et al. |
| 9,315,987 | B2 | 4/2016 | Richardson |
| 9,453,345 | B2 | 9/2016 | Richardson |
| 9,850,658 | B2 | 12/2017 | Alcala Ordaz |
| 10,287,773 | B2 | 5/2019 | Taleb |
| 2002/0162294 | A1 | 11/2002 | Beliveau |
| 2004/0040240 | A1 | 3/2004 | Patz et al. |
| 2005/0028466 | A1 | 2/2005 | Titishov |
| 2005/0108963 | A1 | 5/2005 | Wostal et al. |
| 2006/0260240 | A1 | 11/2006 | Patz et al. |
| 2008/0028709 | A1 | 2/2008 | Pontarolo |
| 2008/0236084 | A1 | 10/2008 | Pontarolo |
| 2012/0023851 | A1 | 2/2012 | Marshall |
| 2012/0247046 | A1 | 10/2012 | Jewett et al. |
| 2014/0260055 | A1* | 9/2014 | Pfeiffer ..... E04G 11/087 52/582.1 |
| 2017/0321419 | A1* | 11/2017 | Stewart ..... E04B 2/8635 |

FOREIGN PATENT DOCUMENTS

| | | | |
|---|---|---|---|
| CA | 2855739 | | 5/2013 |
| CA | 2855742 | | 5/2013 |
| CA | 2929510 | | 5/2015 |
| CA | 2985420 | | 5/2019 |
| CN | 1041022 | A | 4/1990 |
| CN | 101775897 | A | 7/2010 |
| CN | 102245843 | A | 11/2011 |
| GB | 582256 | | 11/1946 |
| JP | S50130224 | A | 10/1975 |
| JP | H09137537 | A | 5/1997 |
| JP | 2001348983 | A | 12/2001 |
| JP | 2004521210 | A | 9/2007 |
| JP | 2010539351 | A | 10/2013 |
| WO | 1997028324 | | 8/2001 |
| WO | 2007143820 | | 12/2007 |

OTHER PUBLICATIONS

IP Australia, "International Preliminary Report on Patentability," issued in connection with Application No. PCT/AU2017/050938, Aug. 31, 2018, 12 pages.

* cited by examiner

FORMWORK

CROSS-REFERENCE TO RELATED APPLICATIONS

This application is a continuation of U.S. patent application Ser. No. 17/963,811, filed Oct. 11, 2022, titled "Improvements in Formwork," now U.S. Pat. No. 11,920,345, which is a continuation of U.S. patent application Ser. No. 16/328,641, filed Feb. 26, 2019, now U.S. Pat. No. 11,466,452, titled "Improvements in Formwork," which is a national stage entry of International Patent Application No. WO 2018/039731 A1, filed on Sep. 1, 2017, titled "Improvements in Formwork," which claims priority from Australian Patent Application No. AU2016903502, filed on, Sep. 1, 2016, titled "Improvements in Formwork," the disclosures of each of which are incorporated herein by reference in their entirety.

FIELD OF THE INVENTION

The present invention relates to improvements in formwork and in particular, to collapsible formwork elements that may be used for "lost" formwork.

BACKGROUND OF THE INVENTION

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Formwork is used for shaping concrete structures. For example, when constructing a building or the like, a temporary formwork structure is first constructed, and then concrete is poured into the formwork. The concrete then sets in line with the formwork structure. In some forms, the formwork is "lost" formwork, and is not removed after the concrete has set. "Lost" formwork is rather left in place to become part of the final concrete structure.

Conventional "lost" formwork is not typically economical as it is usually produced from injection moulded parts, made from multiple materials, and/or requires significant manual labour to assemble. Furthermore, conventional "lost" formwork has other disadvantages in that it can be bulky and difficult to transport. As it cannot be readily reduced in size, practical use is often limited to sites within a certain distance of a production/manufacturing facility. Conventional "lost" formwork also often includes foam panels, which can be damaging to the environment, and difficult to use in combination with adhesives/glues.

The present invention seeks to address at least some of the above mentioned disadvantages associated with conventional "lost" formwork.

SUMMARY OF THE INVENTION

In one broad form, the present invention provides a collapsible formwork element, the element including: a pair of opposing side wall panels; and at least one connector member extending between the side wall panels, wherein the formwork element is movable between an expanded configuration, wherein the opposing panels are spaced apart, and a collapsed configuration, wherein the opposing panels are relatively closer together.

In one form, the at least one connector member includes at least one hinge portion that permits movement of the element between the expanded and collapsed configurations. In one form, the at least one connector member includes two hinge portions.

In one form, the at least one connector member is hingedly connected to the opposing side wall panels.

In a further broad form the present invention provides, a collapsible formwork element, the element including: a pair of opposing side wall panels; and at least one connector member extending between the side wall panels, wherein the at least one connector member includes at least two hinge portions that permit movement of the element between an expanded configuration, wherein the opposing panels are spaced apart, and a collapsed configuration, wherein the opposing panels are relatively closer together.

In one form, the at least one connector member includes a centre panel between a pair of hinged ends provided by the hinge portions. In one form, the hinged ends are configured to be engaged with the side wall panels.

In one form, the hinge portions are formed of a material that is more flexible than the material forming the reminder of the connector member, which is substantially rigid, so as to provide a hinge type action. In one form, the connector members are produced via co-extrusion, with a first extrusion material forming the hinge portions and a second extrusion material forming the remainder of the connector member.

In one form, the hinge portions are provided by a narrowing or thinning in the connector member. In one form, the hinge portions are provided by a relative reduction in connector member thickness so as to provide a fold line that permits bending of the connector member.

In one form, the at least one connector member is realisably attachable between the opposing side panels. In one from, the opposing side wall panels include slots therein to respectively receive the hinged ends of the least one connector member via a sliding engagement. In one form, the hinged ends of the at least one connector member are shaped fit the slots so as to provide a frictional engagement therein.

In one form, in the expanded configuration, the centre panel/s of the at least one connector member extend substantially perpendicular to the opposing side wall members.

In one form, the formwork element includes a plurality of connector members.

In one form, the formwork element is configured to snap lock into the expanded configuration. In one form, snap locking is provided a hook tab that extends from the at least one connector member and is configured to engage a corresponding catch projection on one of the opposing side wall members as the formwork element moves into the expanded configuration.

In one form, the side wall panels include one or more channels therein extending substantially vertically therethrough. In one form, the one or more channels include an insulating material therein.

In one form, the lateral ends of the opposing side wall panels include engagement portions for engagement with like collapsible formwork elements so as to allow formation of a formwork structure comprised of a plurality of the collapsible formwork elements. In one form, the engagement portions are configured to provide snap lock engagement between neighbouring formwork elements.

In one form, in the collapsed configuration, the distance between the opposing walls panels is less than ⅓ the distance between the opposing wall panels in the expanded configuration. In one form, in the collapsed configuration, the distance between the opposing walls panels is less than ¼ the distance between the opposing wall panels in the expanded configuration. In one form, in the collapsed configuration, the distance between the opposing walls panels is less than ⅕ the distance between the opposing wall panels in the expanded configuration.

In one form, the at least one connector member and side wall panels are each separately formed as single extruded pieces.

It will be appreciated that, in a further aspect, the present invention is also embodied in the connector members and/or a side wall panels when provided separately, for use in the collapsible formwork elements as described herein.

BRIEF DESCRIPTION OF THE DRAWINGS

An example of the present invention will now be described with reference to the accompanying drawings, in which.

DETAILED DESCRIPTION OF THE DRAWINGS

Figure 1:
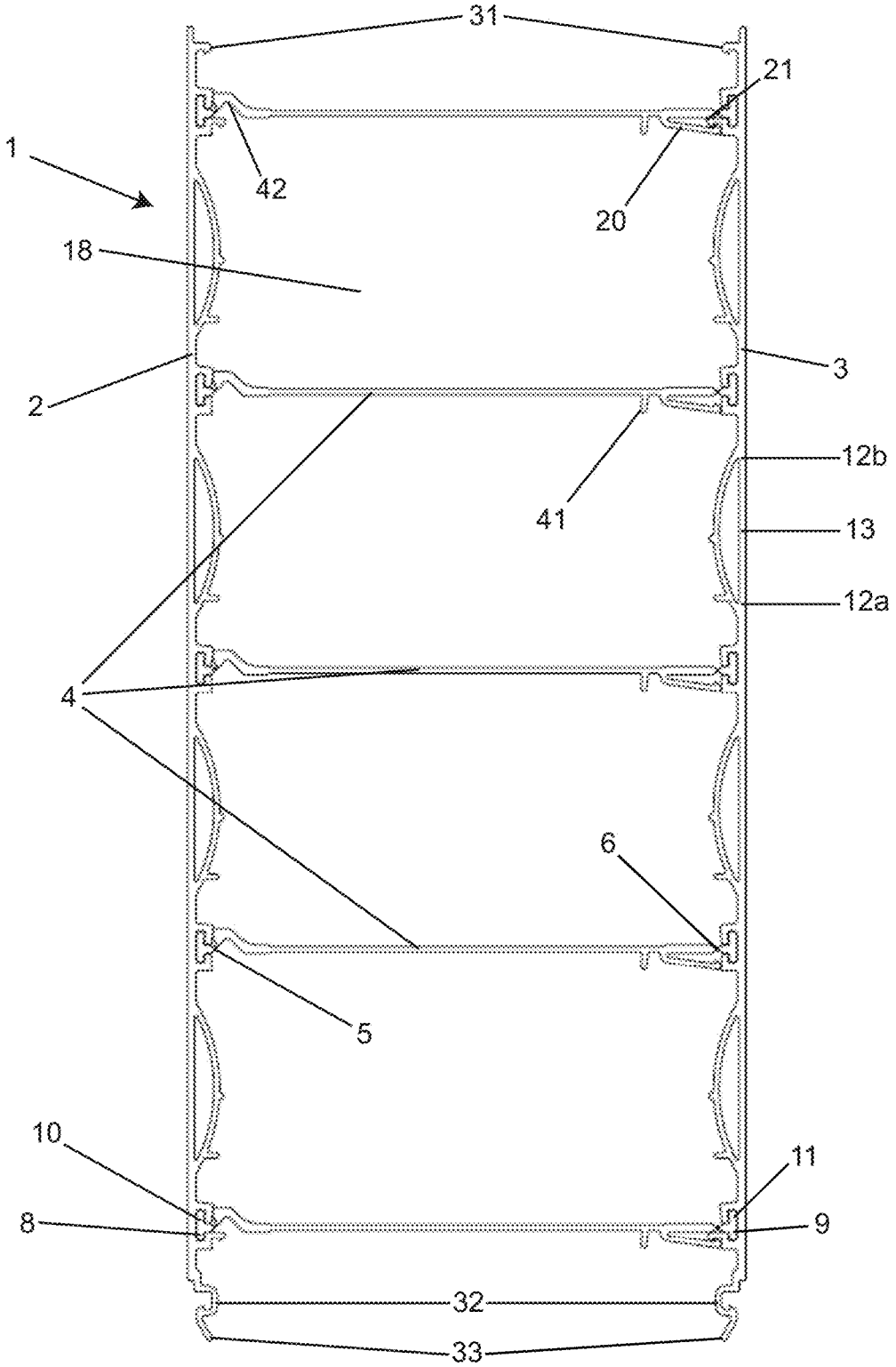
FIG. 1 is a top view of one example of a collapsible formwork element in the expanded configuration.
Figure 2:
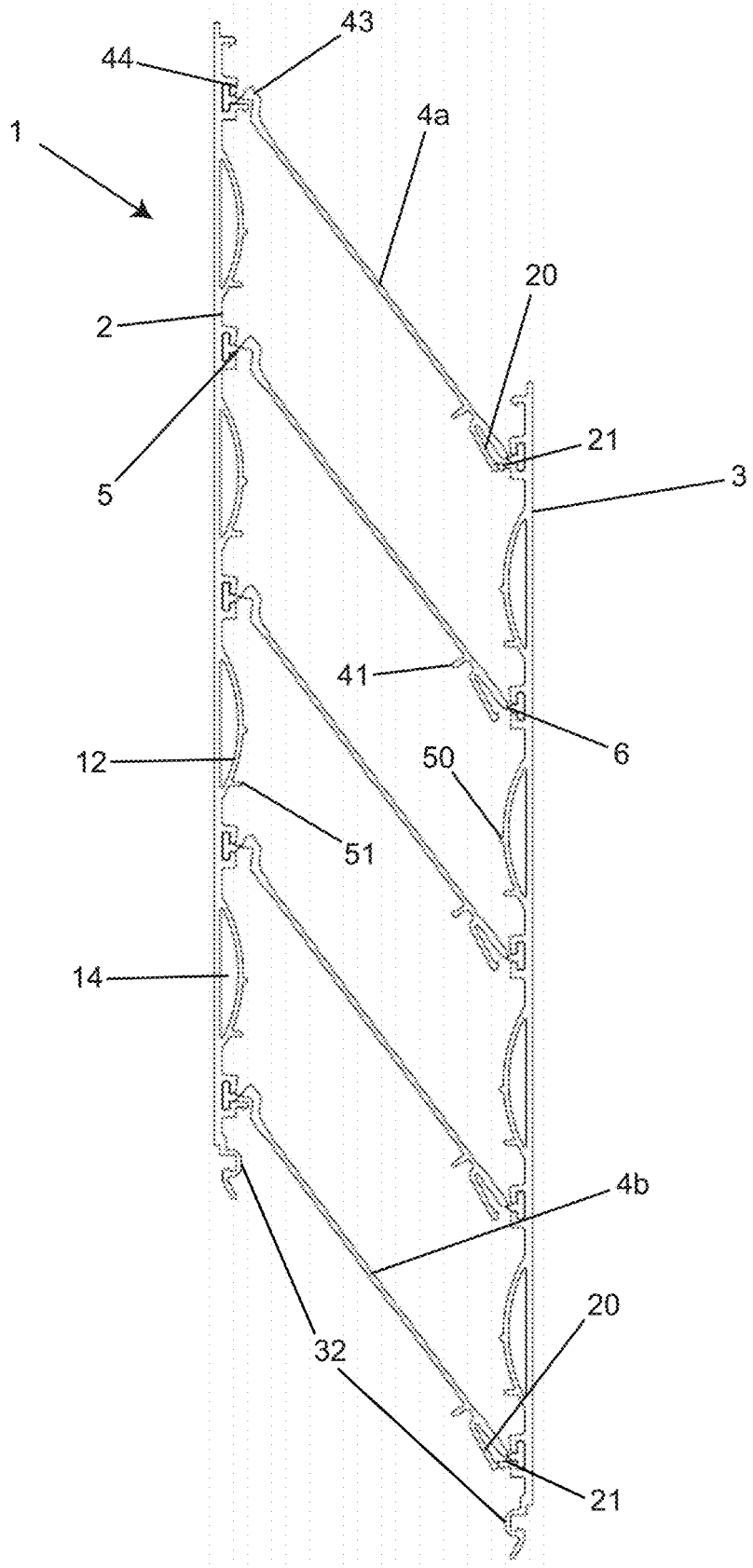
FIG. 2 is a top view of the collapsible formwork element of FIG. 1 in a partly collapsed configuration.
Figure 3:
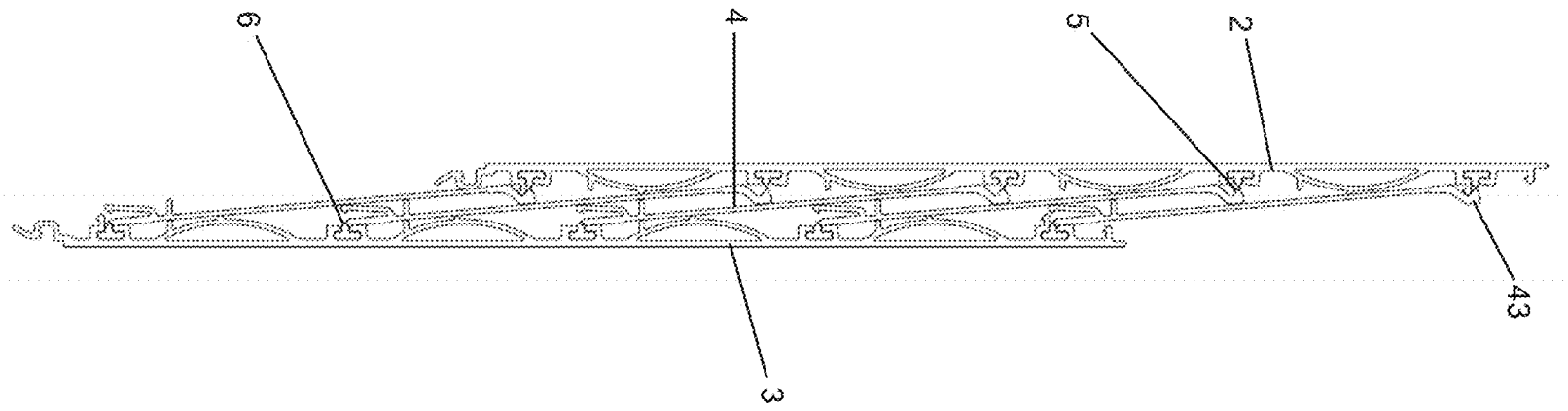
FIG. 3 is a top view of the collapsible formwork element of FIG. 1 in the collapsed configuration.

A first set of embodiments of the present invention provides a collapsible formwork element. The element includes a pair of opposing side wall panels and at least one connector member extending between the side wall panels. The formwork element is movable between an expanded configuration, wherein the opposing panels are spaced apart, and a collapsed configuration, wherein the opposing panels are relatively closer together.

Being collapsible, the presently described formwork element provides significant space saving advantages. For example, in use, the formwork element may be transported/delivered in the collapsed configuration, allowing more elements to be transported per trip. Once on site, the element(s) may be expanded to provide a concrete receiving cavity and positioned in place. The element(s) may also be stored on site in the collapsed state, requiring less space than conventional non-collapsible formwork elements.

Generally, the collapsible formwork element includes a plurality of connector members extending between the side wall members. In one form, the connector member/s include at least one hinge portion that permits movement of the formwork element between the expanded and collapsed configuration. In one example, the connector member/s include two hinge portions.

Generally, the connector members include a centre panel between a pair of hinged ends, that are respectively configured to be engaged with the side wall panels. In the expanded configuration, the connector member panels typically extend substantially perpendicular to the opposing side wall members to provide rectangular channels in the concrete receiving cavity of the formwork element. In the fully collapsed configuration, the connector members bend at the hinge portions and the connector member centre panel extends substantially parallel to the opposing side walls, and is sandwiched therebetween.

The hinge portion/s may be provided by a thinning or narrowing in the connector member/s. For example, the hinge portion/s may be provided by a relative reduction in connector member thickness so as to provide a fold line that permits bending of the connector member. In such examples, the connector members may be produced from a plastic or polymer material, which, when sufficiently thin, has enough flexibility to allow bending. In one example, the connector members are produced from a polymer material, such as, for example polypropylene or polyvinylchloride. It will be appreciated that a range of materials may be used to produce the connector member/s (i.e. not only polymers/plastics), and that the hinge portions/mechanism may also vary.

In other examples, the hinge portions are not provided by a thinning/narrowing, but rather, by incorporating a more flexible material. For example, the hinge portions may be formed of a material that is more flexible than the material forming the remainder of the connector members so as to allow a hinge type action. It will be appreciated that apart from the hinge portions, the connector members are generally substantially rigid to adequately support the side wall panels in the expanded configuration. The connector members may be produced via co-extrusion, with a first extrusion material forming the more flexible hinge portions and a second extrusion material forming the more rigid remainder of the connector members.

In other forms, instead of the connector member/s including the hinge portion/s, the connector member/s may be hingedly connected to the side wall members so as to permit movement between the expanded and collapsed configurations.

Generally the connector member panels include apertures therein so as to form webs between the side wall panels. During filling, concrete poured into the concrete receiving cavity of the element is thereby permitted to flow between the rectangular channels defined by the connector members. The connector member panels, whilst facilitating expansion/collapse of the formwork element, may therefore also contribute to reinforcement of the finished concrete product via composite action with the concrete.

Typically, the connector member/s are realisably attachable to the opposing side wall panels, such as, for example, via a sliding engagement. For example, each of the opposing side wall panels may include slots therein to respectively receive opposite hinged ends of the connector member/s. In other examples, the connector member/s and side wall panels may be formed of a unitary construction. Generally, the formwork elements as described herein also typically snap lock into the expanded configuration. This can help to avoid the formwork elements collapsing unintentionally after placement. It will be appreciated that in some instances, snap locking may be disengaged with human interaction. It will also be appreciated that the structures/elements that provide snap locking may vary. It will also be appreciated that in some forms, the elements may be mechanically maintained or locked in the expanded configuration by means other than snap locking, such as, for example, by a plug and recess type engagement wherein, for example, a plug on the connector member clicks or plugs into a corresponding recess in a side wall member on expansion. Generally, the formwork element is configured such that maintenance or locking in the expanded configuration is achieved automatically on expansion without additional fasteners. It will be appreciated that locking or maintenance may be permanent or semi-permanent such that the element may be collapsed again after expansion.

Individual formwork elements are also typically configured to be connected together to provide larger formwork structures (like walls or the like) as desired. Generally, to allow engagement between like elements, the lateral ends of the opposing side wall panels include engagement portions. The engagement portions of neighbouring formwork elements engaging with one another to provide the connection between individual elements. Typically the engagement portions are configured to provide snap lock engagement between the elements. It will be appreciated that a larger formwork structure may include any number of individual formwork elements connected together. Additionally, end pieces may be provided to cap unused ends of the elements/formwork structure. The end pieces also typically being configured for snap lock engagement with the engagement portions of the formwork elements. In addition to end pieces, junction pieces (e.g. T junctions) may also be provided to connect two or more formwork elements or to connect formwork elements in a configuration which differs from than if they were connected directly together (e.g. right angles). The junction pieces are also typically configured for snap lock engagement with the engagements portions of the formwork elements.

In some examples, the opposing side wall panels may include internal reinforcement to strengthen areas that may be prone to bulging when concrete is filled into the element. For example, areas of the side wall panels further from the connector members may be prone to bulging as they are not as well supported by the connector members. It will be appreciated that internal reinforcement may take a variety of forms.

In one example, internal reinforcement is provided by one or more internal walls located between connector member slots that define channels/voids in the side wall panel. The internal walls thus provide some spacing between the main concrete receiving cavity and the outer walls of the side wall panels. The internal walls are thus configured such that instead of exerting pressure on the portions the outer wall of the side wall panel between the two connector members (i.e. near the mid point, which is typically less supported and prone to bulging), concrete filled into the formwork exerts pressure on the internal walls of the panels. Due to the shape of the internal walls and connection points with the respective outer wall of the side wall panel, pressure from the concrete is redirected to the areas of the side wall panel near to the connector members, which are typically more supported and less likely to bulge (as the connector members themselves provide support).

In one example, the internal walls provide channels with a dome shaped cross section between neighbouring connector members. In other examples, internal reinforcement may be provided by braced internal walls that extend substantially between the slots for receiving the connector members. In such examples, supporting/bracing walls between the internal and outer walls helps distribute pressure from filled concrete across several points of the side wall and also provide additional support to areas prone to bulging.

Generally the channels defined by the internal walls extend in a substantially vertical direction. In some examples the one or more channels defined by the internal walls include an insulating material therein. Furthermore, in some forms the outer surfaces of the side wall panels may include holes therein or may be roughened to improve bounding of coating materials, like render.

One particular example of a collapsible formwork element as described herein is illustrated in FIGS. 1 to 7.

FIG. 1 shows a top view of a collapsible formwork element (1) according to one example. The formwork element (1) includes a pair of opposing side wall panels (2, 3) and a plurality of connectors (4) extending between the panels (2, 3). The formwork element (1) is movable between an expanded configuration (see FIG. 1), wherein the opposing panels (2, 3) are spaced apart, a collapsed configuration (see FIG. 3) wherein the opposing panels (2, 3) are relatively closer together.

Movement between the expanded and collapsed configurations is permitted by two hinge portions (5, 6) in the connector members (4). The hinged portions (5, 6) are provided by a thinning in the connector members (4). At each hinge portion (5, 6), there is a reduction in connector member (4) thickness so as to provide a fold line that permits bending of the connector member. Operation of the hinge portions (5, 6) is more clearly shown in FIG. 2, which shows a top view of the formwork element (1) when part way expanded.

In this example the connector members (4) and side panels (2, 3) are formed of suitable polymer material such as, for example, polypropylene.

Figure 5:
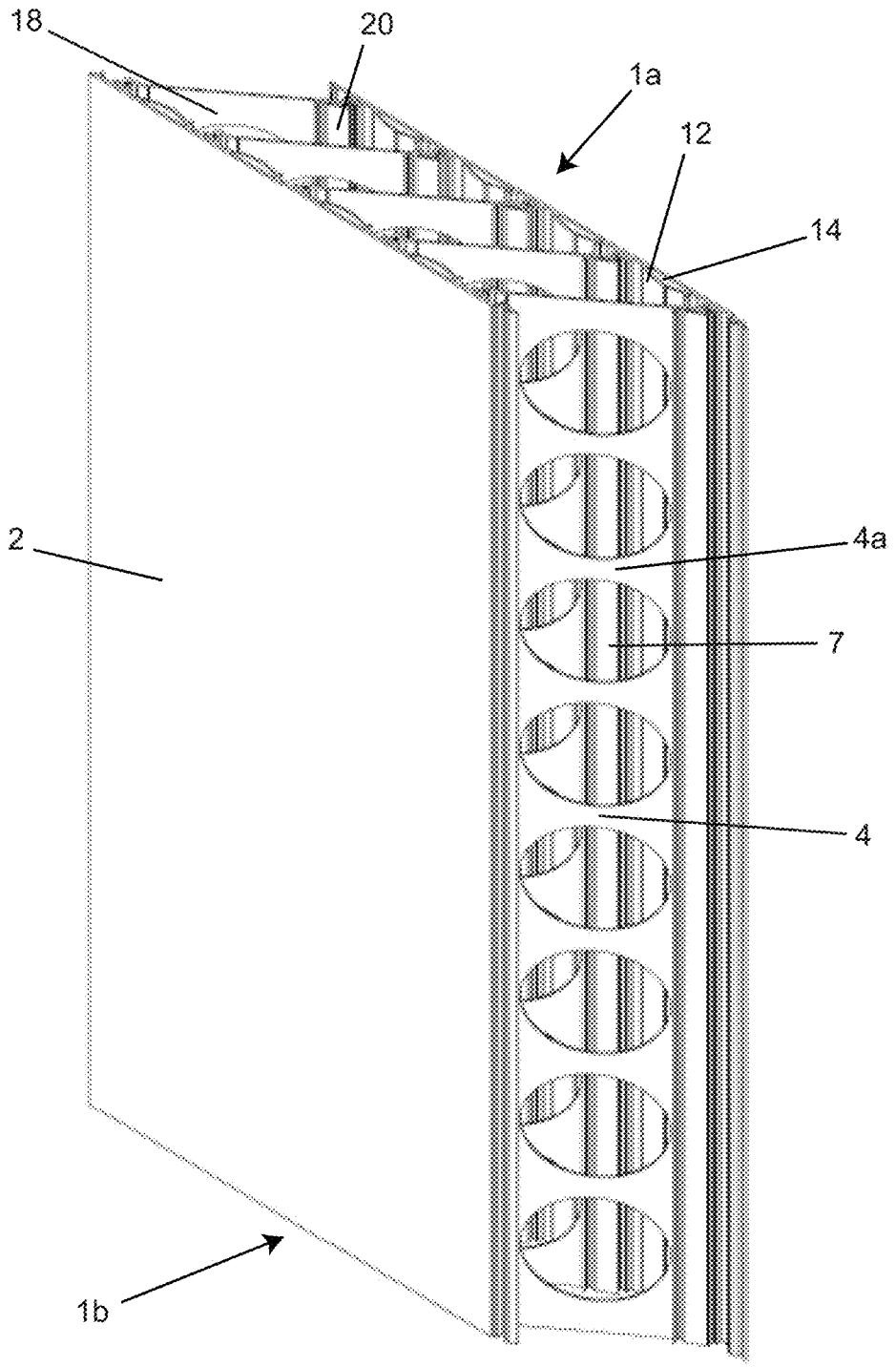
FIG. 5 is an isometric view of the collapsible formwork element of FIG. 1 in the expanded configuration.
Figure 6:
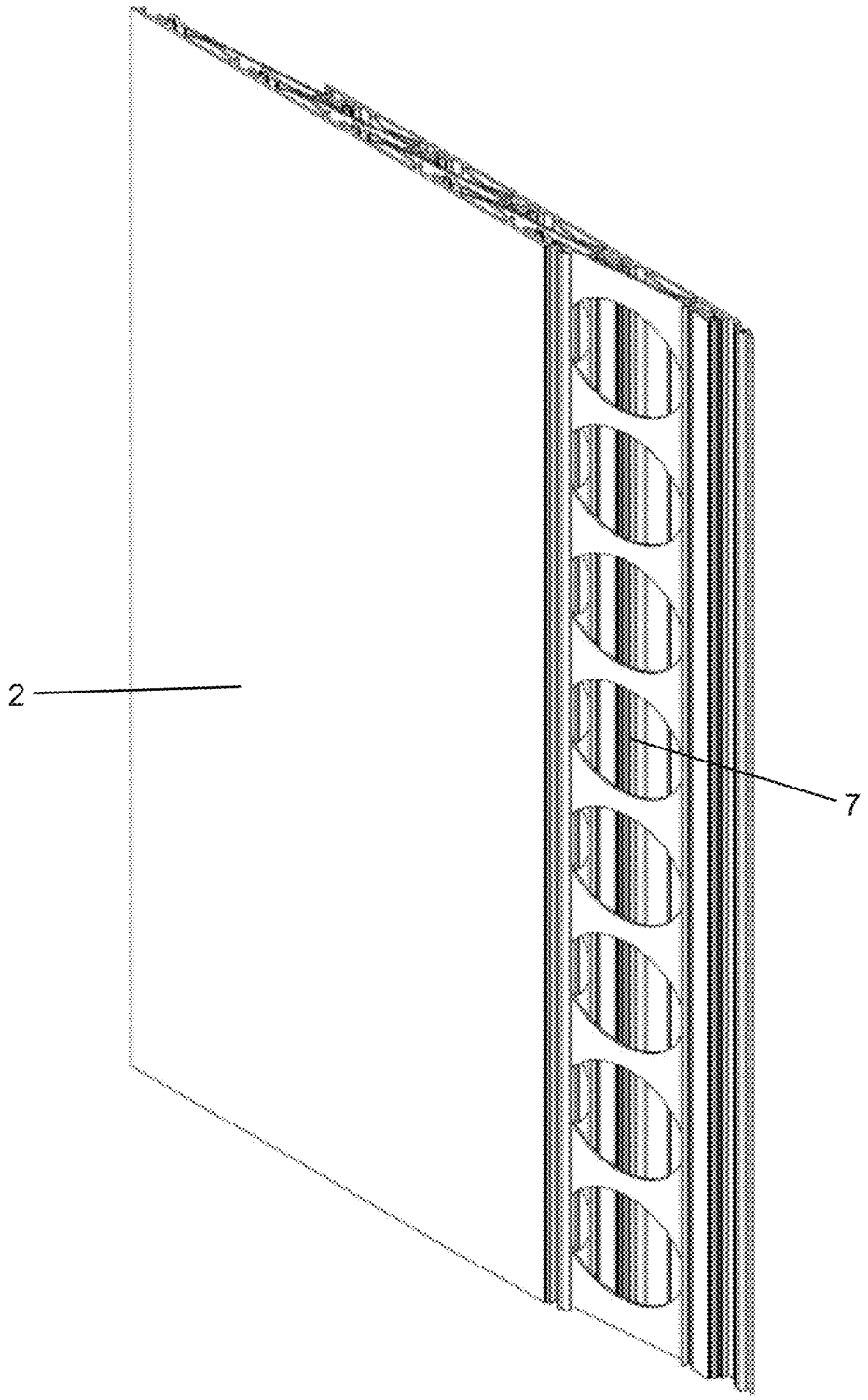
FIG. 6 is an isometric view of the collapsible formwork element of FIG. 1 in a partly collapsed configuration.
Figure 7:
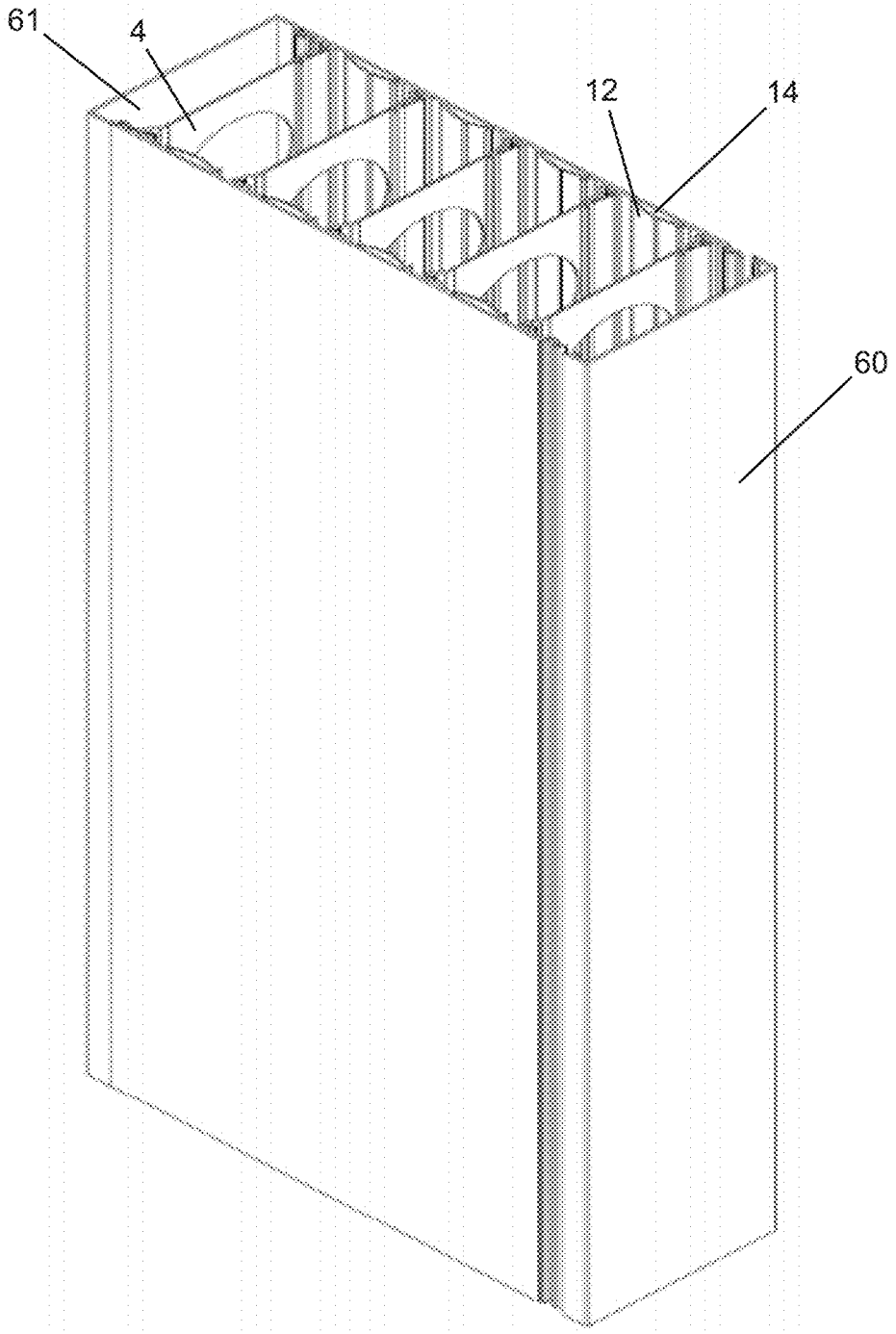
FIG. 7 is an isometric view of the collapsible formwork element of FIG. 1 in the expanded configuration.
Figure 8:
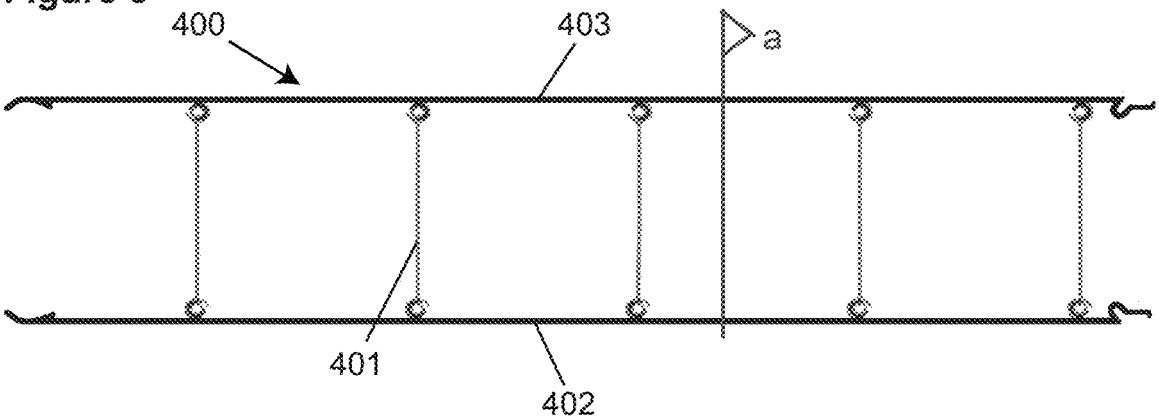
FIG. 8 is a top view of a further example of a collapsible formwork element in the expanded configuration wherein connector members are hingedly connected to the side wall panels.
Figure 9:
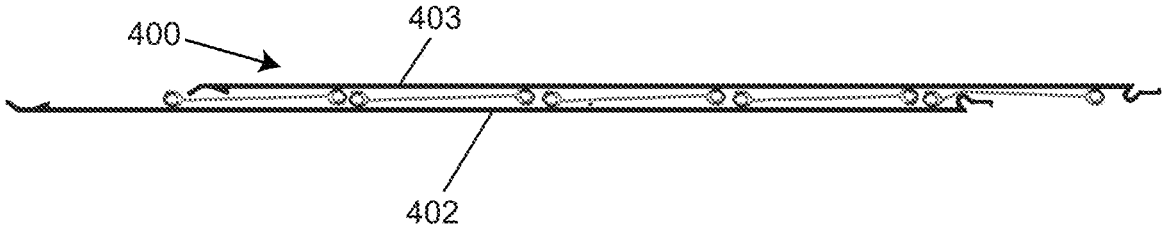
FIG. 9 is a top view of the formwork element of FIG. 8 in the collapsed configuration.
Figure 10:
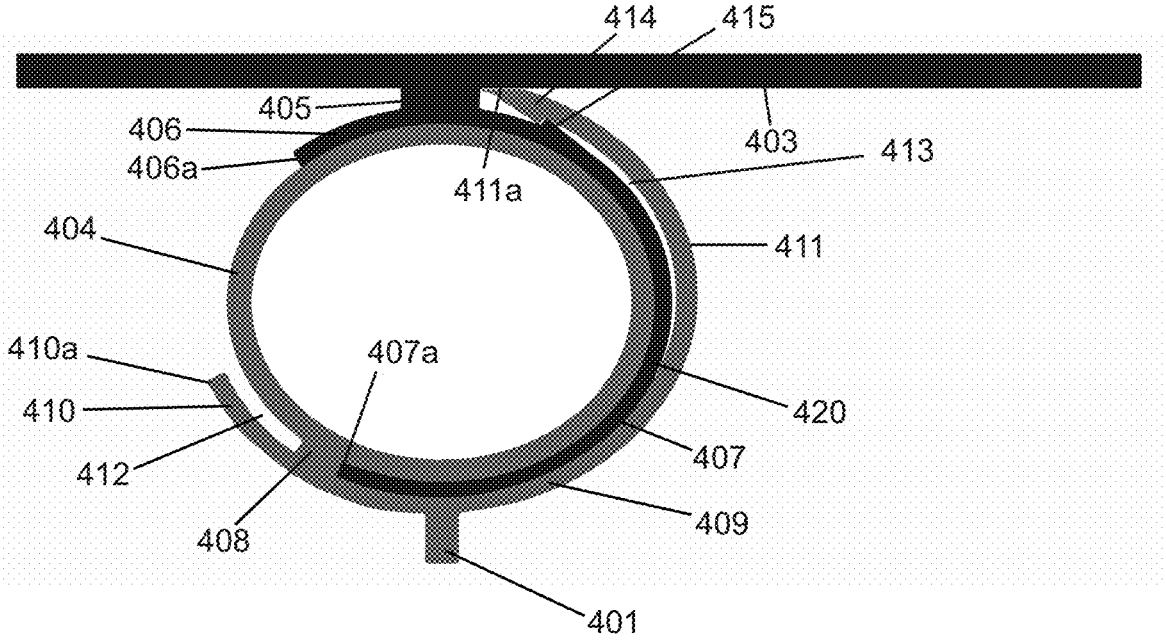
FIG. 10 is an enlarged view of the hinged connection between a sidewall panel and a connector member of the formwork element of FIG. 8.
Figure 11:
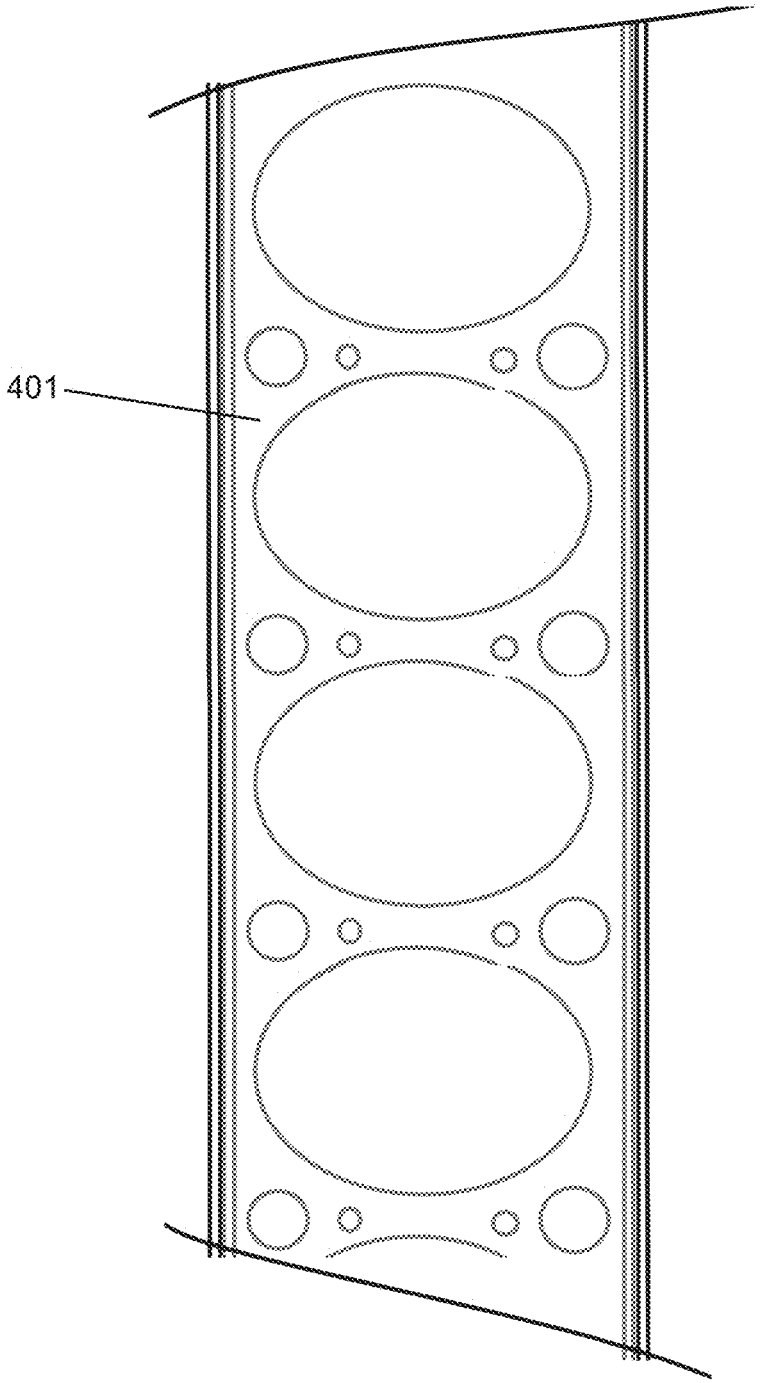
FIG. 11 is a side view of the connector member of the formwork element of FIG. 8.

As is more clearly shown in FIGS. 5 to 7, which are isometric views of the formwork element (1), the connector members (4) include apertured centre panels (or webs) having hinged ends (10, 11) that are configured to be engaged with the side wall panels (2, 3). In the expanded configuration, the panels (4*a*) extend substantially perpendicular to the side wall panels (2, 3) so as to provide substantially rectangular channels (18) in the concrete receiving cavity of the formwork element. During filling, the apertures (7) in the connector member panels (4*a*) provide a path for concrete to flow between the rectangular channels (18) of the element (1). The web like structure created by the apertured panels (4*a*), helps to provide reinforcement to the final concrete structure. As shown in FIGS. 5 to 7, the connector member panels (4*a*) also extend substantially the entire height of the formwork element (1) i.e. from the top (la) to the bottom (1*b*).

Figure 12:
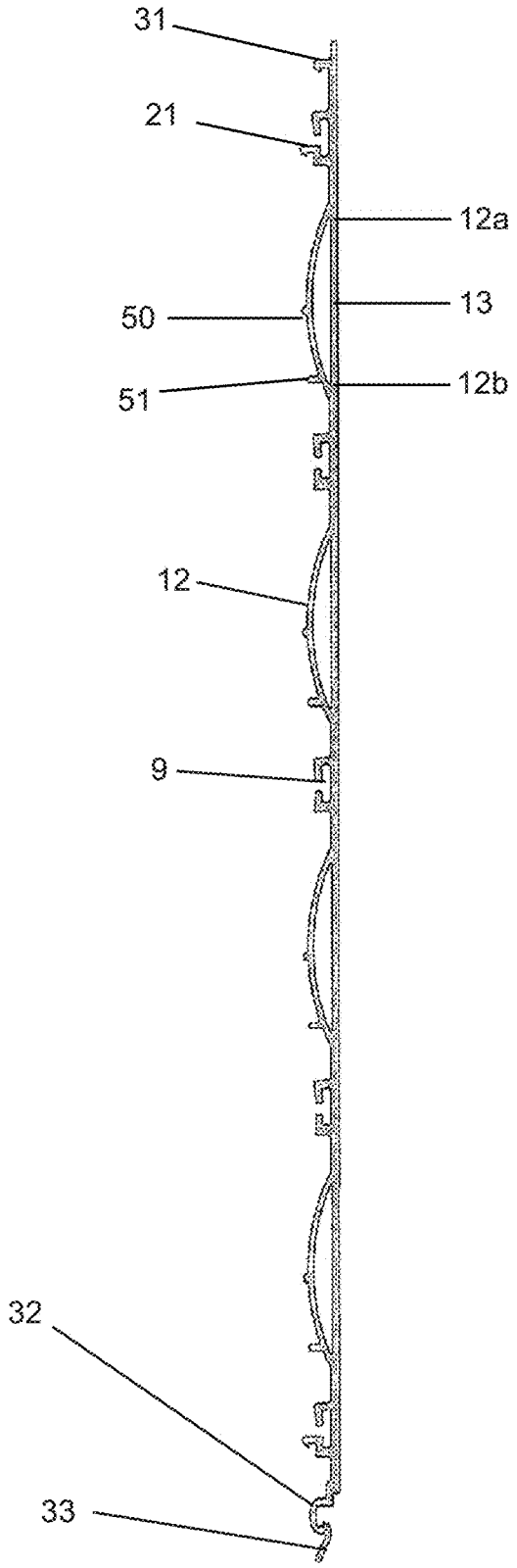
FIG. 12 is a top view of a single side wall panel of the formwork element of FIG. 1.
Figure 13:
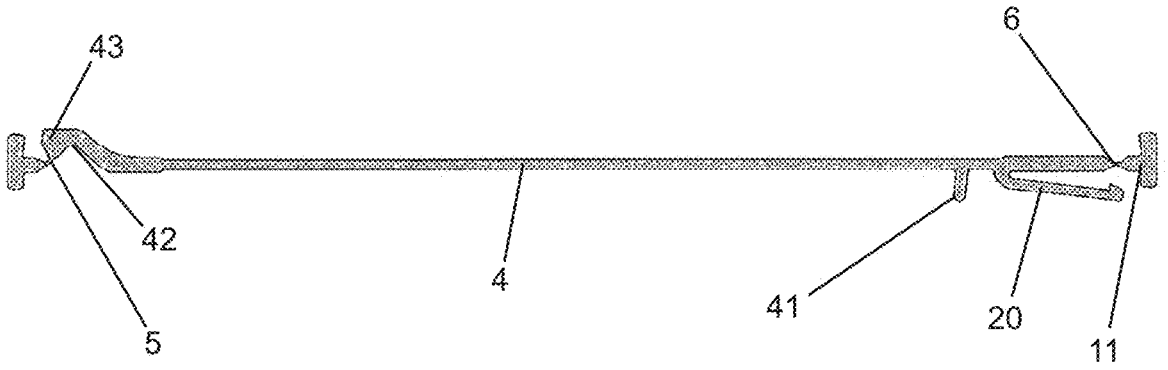
FIG. 13 is a top view of a connector member of the formwork element of FIG. 1.
Figure 14:
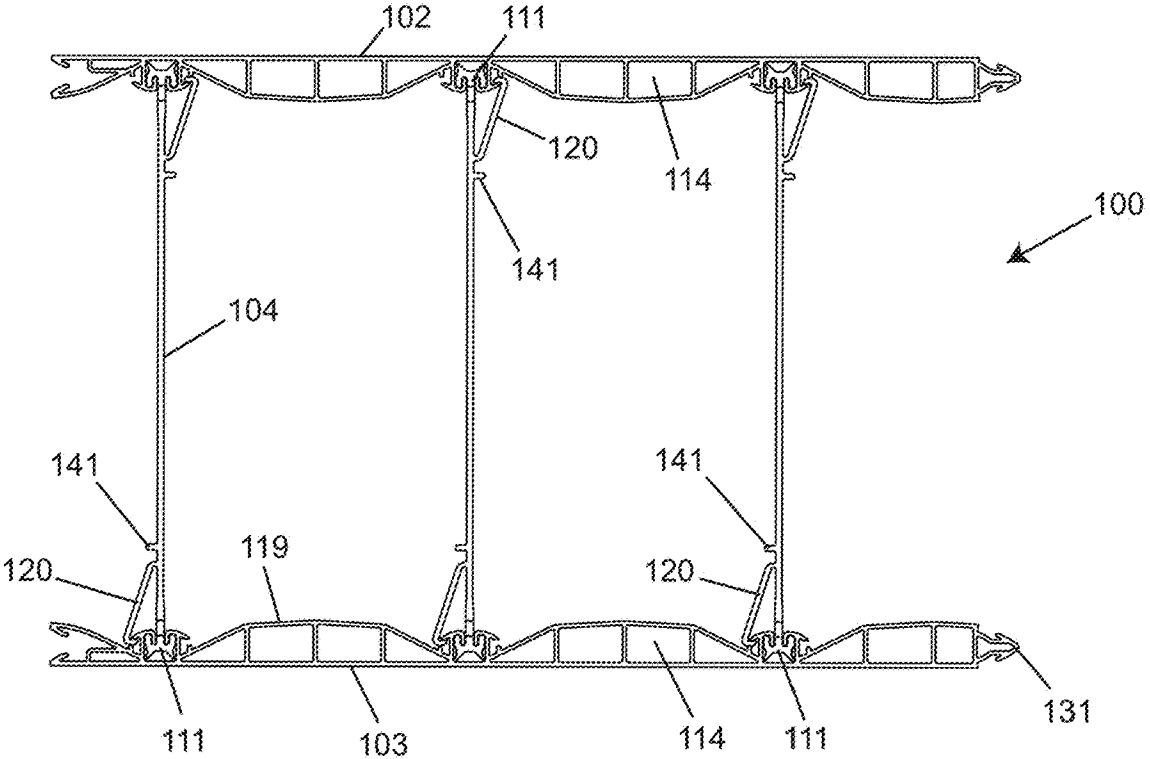
FIG. 14 is a top view of one example of a collapsible formwork element in the expanded configuration.
Figure 15:
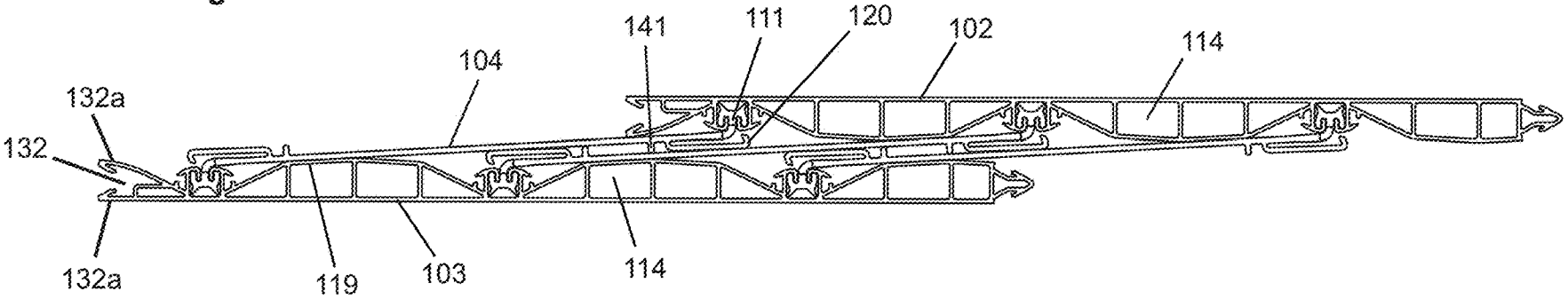
FIG. 15 is a top view of the collapsible formwork element of FIG. 14 in the collapsed configuration.
Figure 16:
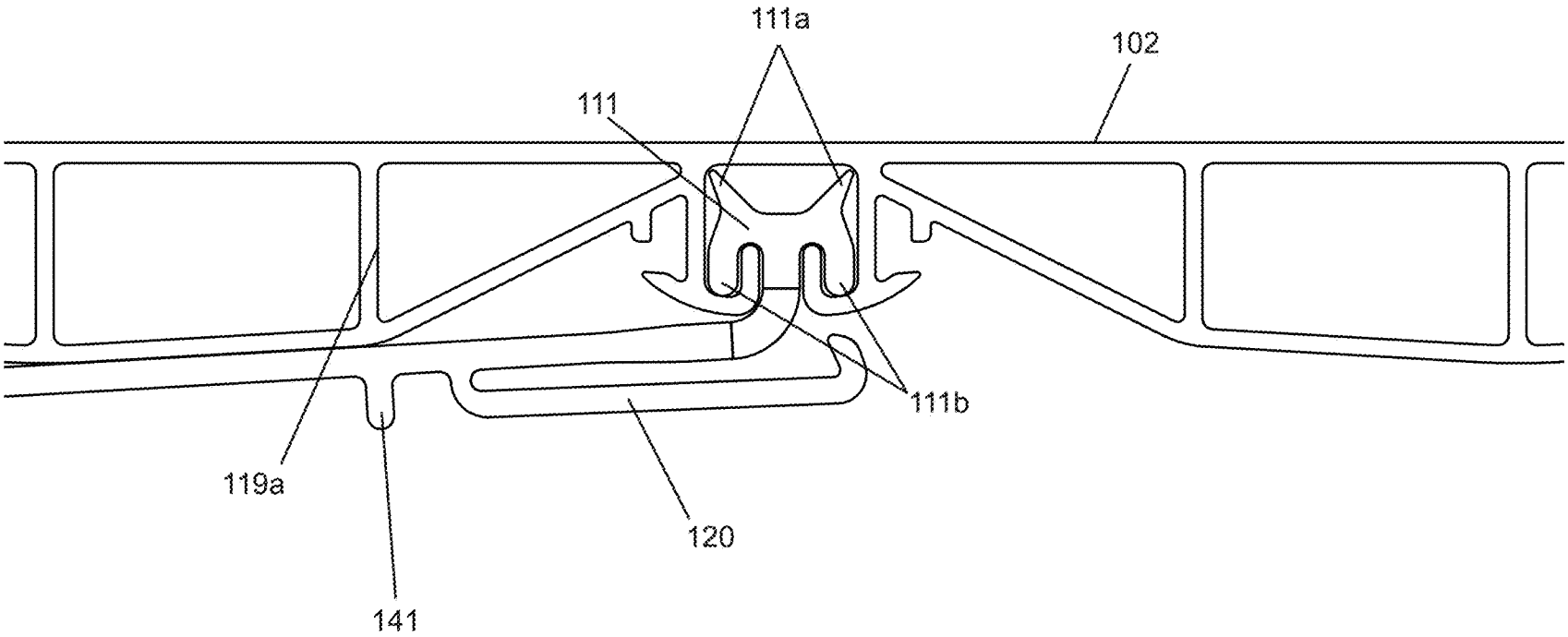
FIG. 16 is a close up top view of engagement between connector member and side wall panel of the element as shown in FIG. 15.
Figure 17:
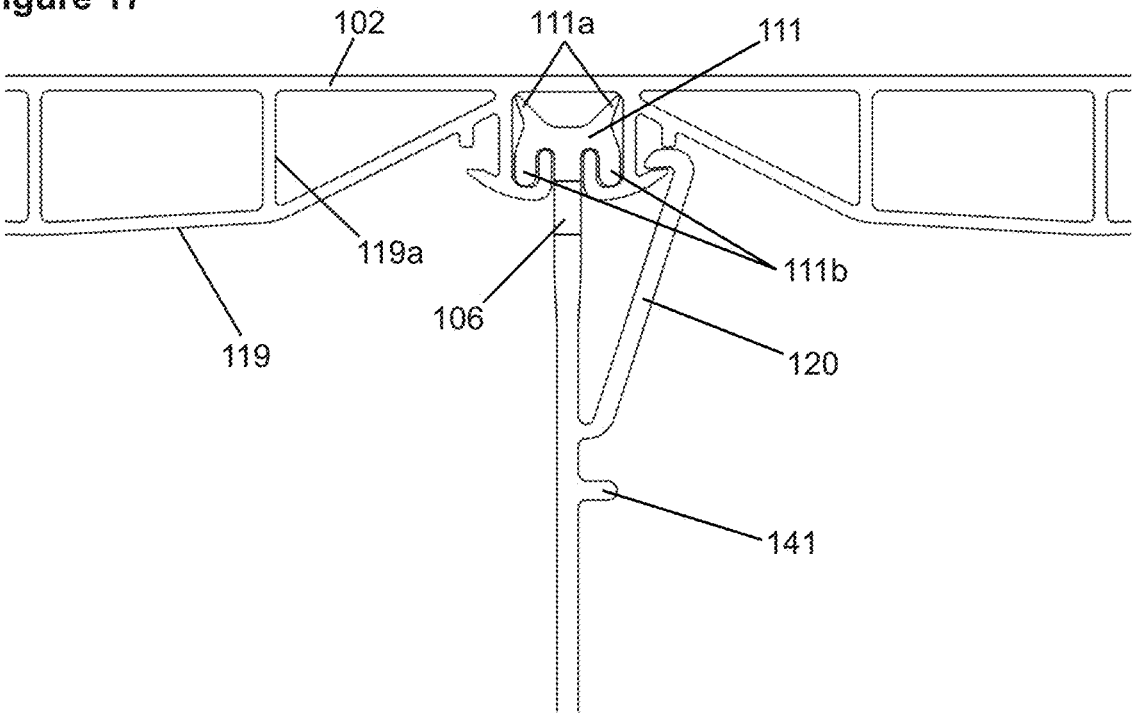
FIG. 17 is a close up top view of engagement between connector member and side wall panel of the element as shown in FIG. 14.

The connector members (4) are also releasably engaged to the opposing side panels (2, 3) via a sliding engagement with slots (8, 9) in the side wall panels (2, 3). The slots (8, 9) in the side wall panels (2, 3) being configured to receive respective opposite hinged ends of connector members (10, 11). It will be appreciated that this releasable engagement permits components of the formwork (e.g. connector members, side wall panels etc.) to be manufactured separately. Furthermore, it will be appreciated that as the components typically have a fixed cross sectional profile, and are typically formed of a polymer/plastic material, more cost effective manufacturing techniques may be used such as, for example, extrusion. FIGS. 12 and 13 show the side wall (e.g. 102, 103) and connector member (4) when separate.

When the formwork element (1) is moved into the expanded configuration, it snap locks into position such that it cannot easily be returned to the collapsed configuration without human intervention. Seen most clearly in FIGS. 1 to 4, snap lock engagement is provided by hook (or barbed) tabs (20) that extend outwardly from one side of the connector member panels (4*a*). The hook tabs (20) are configured to engage with corresponding catch projections (21) at respective neighbouring side wall panels (3), as the connector member (4) moves into the expanded configuration. The hook tabs (20) being flexible yet resilient such that they slide over the lip of the catch projections (21) during movement into the expanded configuration (see FIG. 2), before snapping into place, hooking on to the catch projection (21). Movement into the collapsed configuration is thus substantially prevented by engagement between hook tabs (20) and catch projections (21). It will be appreciated that the snap lock engagement may be disengaged by human intervention.

In the example of the figures, snap engagement with catch projections (21) is only shown to be used with the outer most connector members (4*a*, 4*b*). However, it will be appreciated that this may not always be the case, and they may form part of the side walls (2, 3) to engage all or a plurality of the connector members (4).

Furthermore, at the other end of the connector members (4) (i.e. opposite the snap engagement end), the connector members (4) are shaped to provide further support against collapse. These ends of the connector members (4) include a kink (42), which provides a stop ridge (43) that prevents over-rotation of the connector members (4) in the expansion direction by contacting stop wall portion (44) of side wall (2).

The opposing side wall panels (2, 3) also include internal reinforcement to help strengthen the side wall panels. In particular, internal walls (12) help redirect the pressure of from concrete received in concrete receiving cavity (18) away from less supported parts of the side walls (typically towards areas supported by connector members). This helps to prevent bulging at the parts of the side walls that are less supported by the connector members. The internal walls (12) provide channels/voids (14) in the side walls with a substantially dome shaped cross section. The internal walls (12) are rounded and have ends (12*a*, 12*b*) that join to the outer wall (13) of the side wall panels (e.g. 2 or 3) near to the connector members (4). The internal walls (12) thereby space the main concrete receiving cavity from the less supported parts of the outer wall (13). Pressure exerted on the rounded wall (12) from received concrete is redirected towards ends (12*a*, 12*b*) of the rounded wall (12) near to the connector members (4), where the outer wall (13) is more supported.

The rounded wall (12) also includes support projections (50, 51) thereon that contact the connector members (4) in the collapsed configuration. The support projections (50, 51) help to support the connector members (4) in the collapsed configuration. Additionally, the connector members (4) themselves also include substantially transversely extending projections (41) which support neighbouring connector members when in the collapsed configuration. In the collapsed configuration, the transverse projections (41) of the connector members (4) align with projections (50, 51) provided on the rounded walls (12). It will be appreciated that the connector members (4) and/or side wall members (2, 3) may include other support projections to provide support in the collapsed configuration. This support helps to prevent damage to the connector members (e.g. at their thin hinge portions) in the collapsed configuration, such as, for example, during transport.

It will be appreciated that the formwork element as described herein is generally intended for connection with other like elements such that multiple elements may be connected to provide a larger formwork structure such as a wall or the like. Such connection is generally achieved by engagement portions (31, 32) at the lateral ends of the side wall panels (2, 3). At one lateral end, the side wall panels (2, 3) include grooves (32), whilst at the other end, the panels (2, 3) includes projections (31). The projections (31) of one element being configured for snap lock engagement within the grooves (32) of a neighbouring element (and vice versa). During connection, the projections (31) slide against angled surfaces (33) before snapping back into the grooves (32) to provide a secure engagement between neighbouring elements.

Figure 4:
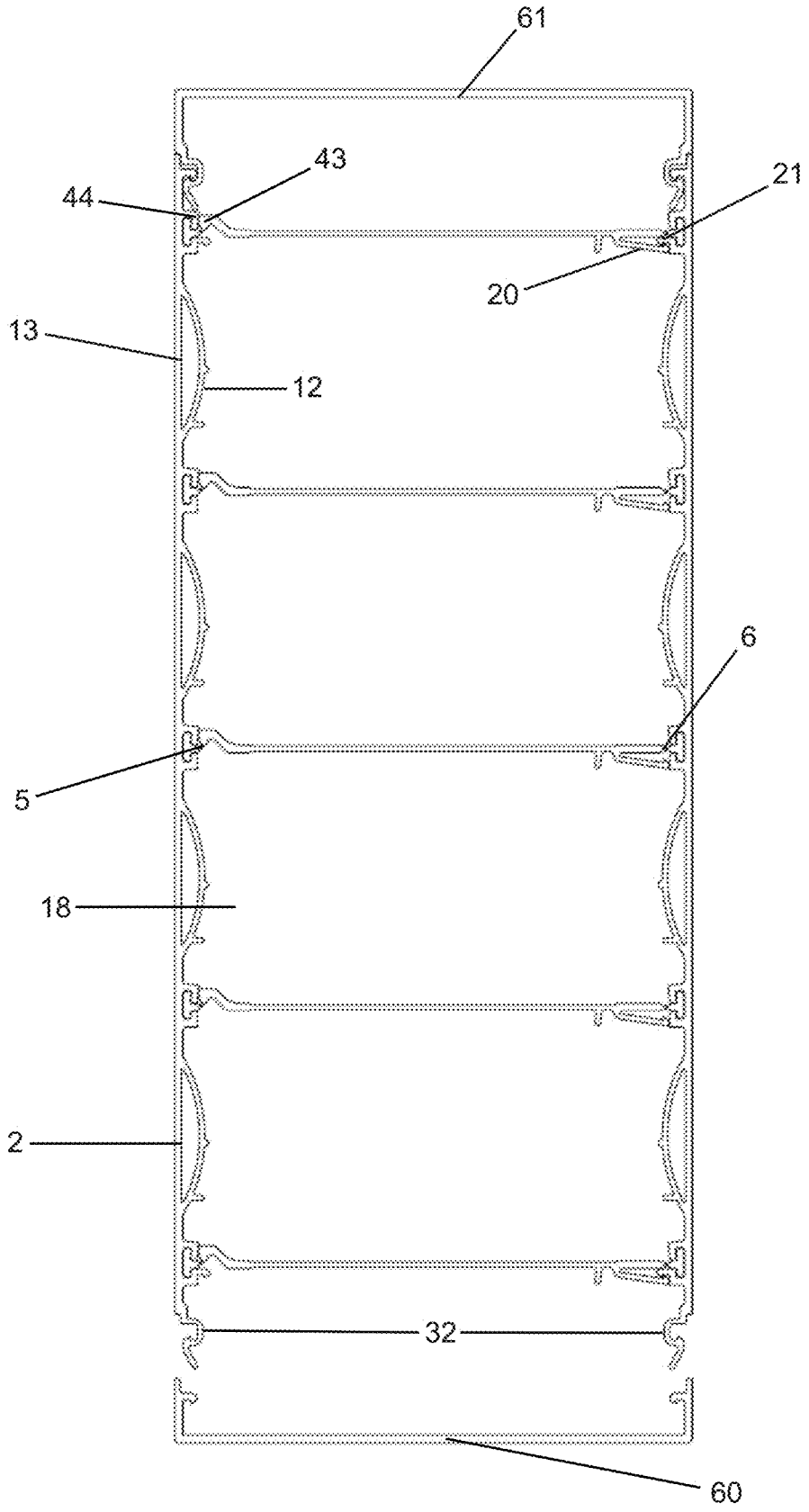
FIG. 4 is a top view of the collapsible formwork element of FIG. 1 is the expanded configuration with end pieces attached.

In addition to multiple elements being connected together, end pieces (60, 61) may also be secured to the engagement portions (31, 32). For example, after a particular formwork structure comprising a plurality of formwork elements (1) is constructed, end pieces (60, 61) may be used to cap exposed ends. As shown in FIG. 4, there are end pieces (60) configured to fit the grooves (32) of one side of the element (1) and end pieces (61) configured to fit the projections (31) of the other side of the element (1). FIGS. 4 and 7 show end pieces (60, 61) connected with the formwork element (1). In addition to end pieces, it will be appreciated that junction pieces may also be provided that allow connection between two or more individual formwork elements or that allow connection between elements in a configuration that differs from that when the formwork elements are connected directly together.

A further example of the collapsible formwork element is shown in FIGS. 8 to 11. In this example, the formwork element (400) includes connector members (401) that are hingedly connected to the side wall panels (402, 403). In this example, the hinge connections are ball and socket like with the side wall panels (402, 403) including socket portions (420) that have substantially C-shaped cross-sectional profiles and which pivotally encircle substantially cylindrical portions (404) of the connector member (401) ends. Each of the socket portions (420) being mounted on a stem (405) that protrudes from a respective side wall panel (e.g. 402, 403) such that the socket portion (420) is divided to provide a short arc surface arm (406) and a relatively longer arc surface arm (407).

Each of the substantially cylindrical portions (404) of the connector member (401) ends is supported by a stem (408) which connects to a sleeve member (409). The sleeve member (409) also having a substantially C-shaped cross sectional profile with the stem (408) dividing the sleeve (409) so as to provide a short arc surface arm (410) and a relatively longer arc surface arm (411). The stem (408) spacing the sleeve (409) from the substantially cylindrical portion (40) such that a first recess (412) is provided by between the short arc surface arm of the sleeve (410) and the cylindrical portion (404) and a second recess (413) is provided by the larger arc surface arm of the sleeve (411) and the cylindrical portion (404). The outer convex side of the sleeve (409) being joined to the remainder of the connector member (401).

As the formwork element (400) moves between the expanded and collapsed configurations the cylindrical portions (404) pivot within the socket portions (420). In the collapsed configuration the short arc surface arm (406) of the socket member (420) is received in the first recess (412) with over rotation in the collapsing direction stopped by abutment of the end (406*a*) of short arc surface arm (406) with stem (408) of the cylindrical portion (404) and abutment of the end (410*a*) of short arc surface arm (410) of sleeve (409) with stem (405) of the socket portion (420).

Similarly, in the expanded configuration, longer arc surface arm portion (407) of the socket portion (420) is received in the second recess (413) and over-rotation in the expansion direction limited by abutment of the end (407*a*) of the longer arc surface arm (407) of the socket member (420) with the stem (408) of the of the cylindrical portion (404) as well as abutment of the end (411*a*) of the longer arc surface arm (411) of the sleeve (409) with the stem (405) of the socket portion (420).

In addition, the end of the longer arc surface arm (411) of the sleeve (409) includes a barb (414) that engages a ridge portion (415) on the socket portion (420) as the formwork element moved into the expanded configuration so as to provide snap lock engagement in the expanded configuration such the element cannot be readily collapsed. It will be appreciated that the element may be collapsible with human intervention (i.e. to release the snap lock).

A further embodiment of the invention is shown in FIGS. 14 to 25. The element (100) in this embodiment functions similarly to the element (1) shown in FIGS. 1 to 7, however, there are some structural differences.

In particular, the opposing side wall panels (102, 103) include braced internal walls (119) that extend between the slots (109) for receiving the connector members (104). The internal walls (119) provide separation between the main concrete filling cavity (118) and the outer walls (113) of the panels. The internal walls (119) are connected to the outer walls (113) of the panels (102, 103) adjacent the walls of the slots (109) and via their bracing legs (119*a*). The brace legs (119*a*) extend substantially orthogonal from the outer wall (113) of side wall panels (102, 103), and divide the area between the internal wall (119) and outer wall (113) to provide multiple channels/voids (114). It will be appreciated the channel/voids (114) travel from top to bottom of the element (100) in the same direction as the slots (109). The braced internal wall (119) helps to redirect and/or distribute pressure from received concrete along the outer wall (113) so as to minimise bulging.

Figure 25:
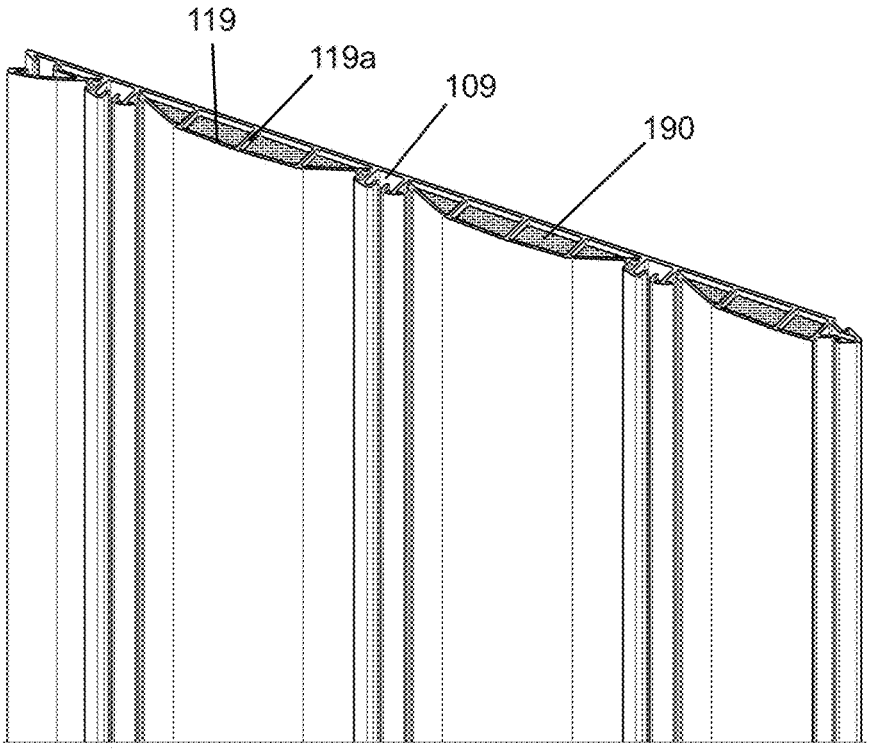
FIG. 25 is an isometric view of one example of a side wall member including an insulating material therein.

In some forms, the channels/voids (114) may be filled with an insulating material (190), such as insulating foam (see FIG. 25, for example). The insulating material may be deposited into the channels/voids (114) in a variety of ways.

In one example, the side wall panels (102, 103) are produced by an extrusion process whereby the main panel material (typically a polymer material like Polyvinylchloride) is extruded through a mould. In such examples, the insulating material (190) may be deposited into the channel voids (114) during the extrusion process. To allow this, an outlet/pipe is built into the mould head through which the insulating material is ejected at the same extrusion rate as the main panel material. After extrusion, there is a cooling process whereby the main panel material stiffens, and the insulating material expands to fill the channels/voids. Typically, the cooling process is provided by cooling water tanks.

When PVC is the main panel material, it typically takes about 3 minutes to stiffen during cooling, and typically, any expansion of the insulation material occurs more slowly and does not act to distort the shape of the side panels.

In some forms, the outer walls (113) of side panels (102, 103) of the element (100), also include a plurality of holes (200). Typically, these are provided by mechanical punching. The holes (200) help any coating/material applied to the outer surfaces of the panels (102, 103), like render, bond more effectively to the panels. Improved bonding is provided by partial penetration of panels (102, 103), with surface coating/material 'grabbing' through the holes (200). The holes (200) provide more effective bonding when compared to a flat surface.

The holes (200) are typically included after extrusion of the panels (102, 103), once the panels (102, 103) have passed through the cooling tanks and dried. Typically, in the production line, the panels (102, 103) are passed through a separate hole punching machine. The holes (200) are generally equi-spaced, and in some examples, are spaced every 20 mm.

Alternatively or additionally to the inclusion of the holes (200), the outer surfaces of the side wall panels (102, 103) may be roughened to improved bonding. For example, the panels may be treated with an etching/roughening formulation, such as, for example, a suitable solvent or acid. Reducing the smoothness (or roughening) the outer surface of the panels, provides an additional means to improve bonding. Typically, in the production line, a separate machine would apply etching/roughening foundation (and wash it off) after extrusion.

In another example, the insulation material (190) may be deposited into the channels/voids (114) via an injection process, whereby the insulating material is injected through the punched holes (200).

The connector members (104) of the element (100) also have several differences when compared to the connector members (4) of the element (1) of FIGS. 1 to 7. As shown most clearly in FIGS. 16 to 19, the connector members (104) have rotational symmetry, whereby hook tabs (120) are provided at both ends. Furthermore, the hinged ends (111) of the connectors (104) also have a substantially 'M' shaped cross section (transverse to the plane of the panels (102, 103)), and the distal/outer vertices thereof extend to pointed tips (111*a*). The 'M' shaped ends are configured to be slidingly engaged within the slots (109) of the opposing side walls (102, 103) in a 4 point contact/frictional engagement.

The tips (111*a*) are pointed/sharp such that on initial insertion into the slots (109), they wear in to the inner surface of the slots, providing additional frictional engagement. The wearing engagement also minimises the 'play' of the connector members (104) once located in the slots (109) (for example when compared to the ends (11) of the element (1)). The 'M' shaped cross sections also provide leg portions (111*b*) that are configured to fit within corresponding internal channels (150) in the slots (109).

Figure 18:
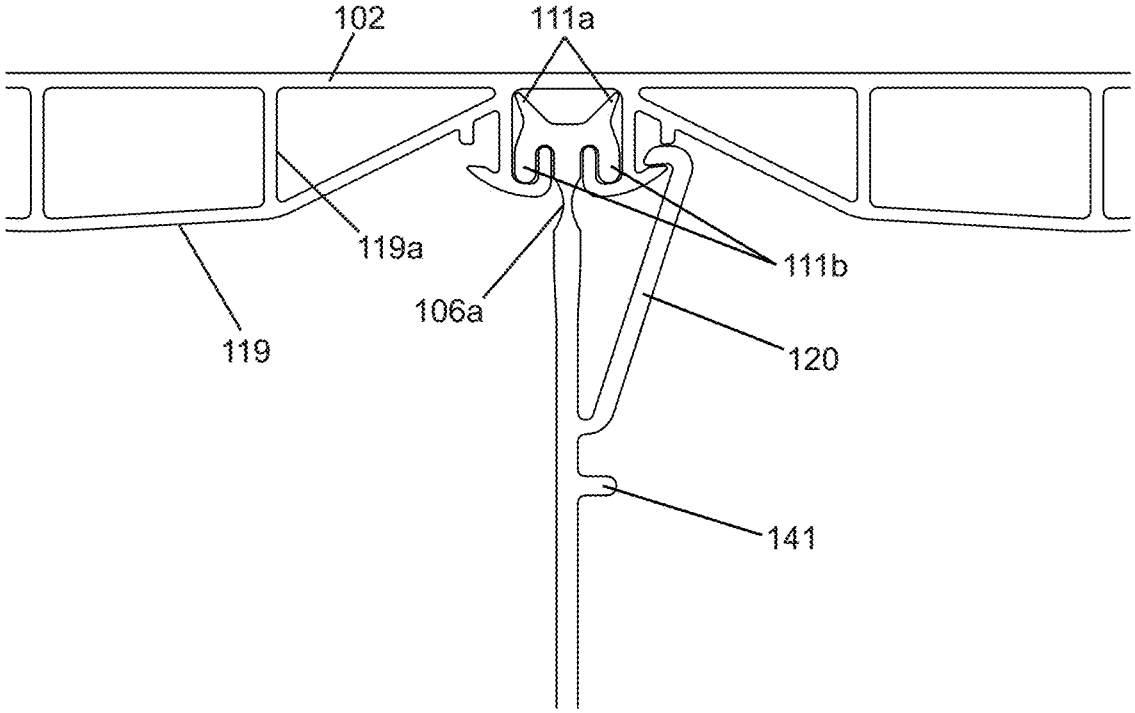
FIG. 18 is a close up top view of engagement between connector member and side wall panel of the element with hinge portion provided by a narrowing in the connector member.
Figure 19:
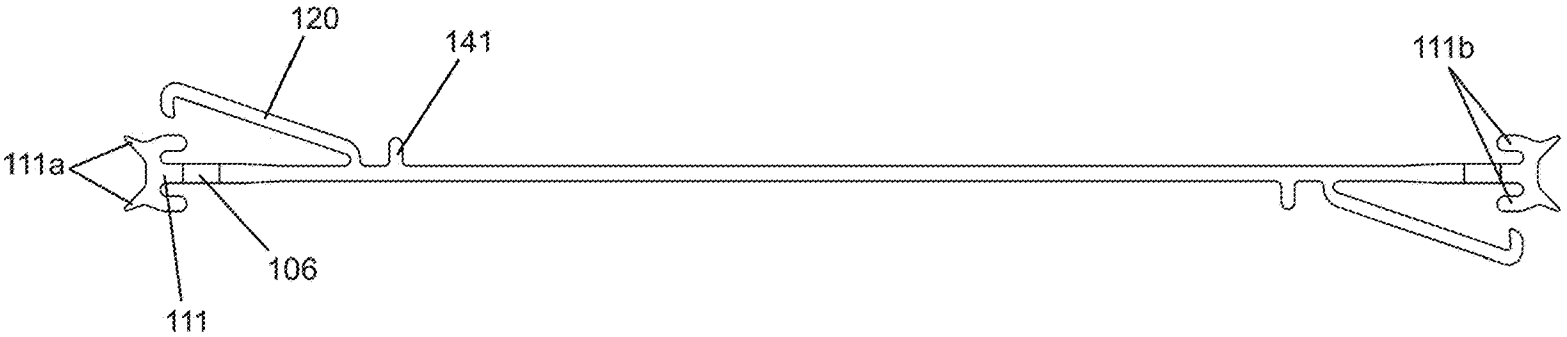
FIG. 19 shows a top view of the connector member of FIGS. 14 and 15.
Figure 20:
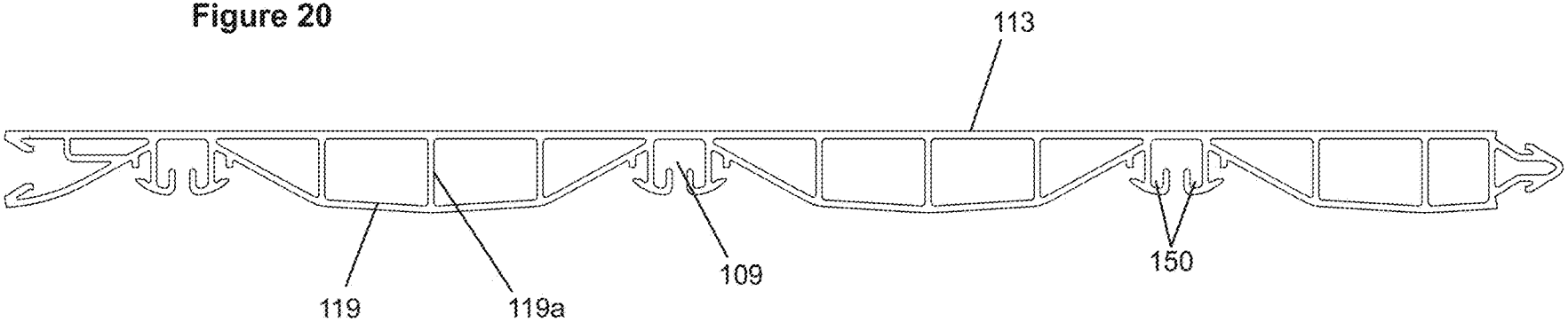
FIG. 20 shows a top view of the side wall panel of FIGS. 14 and 15.
Figure 21:
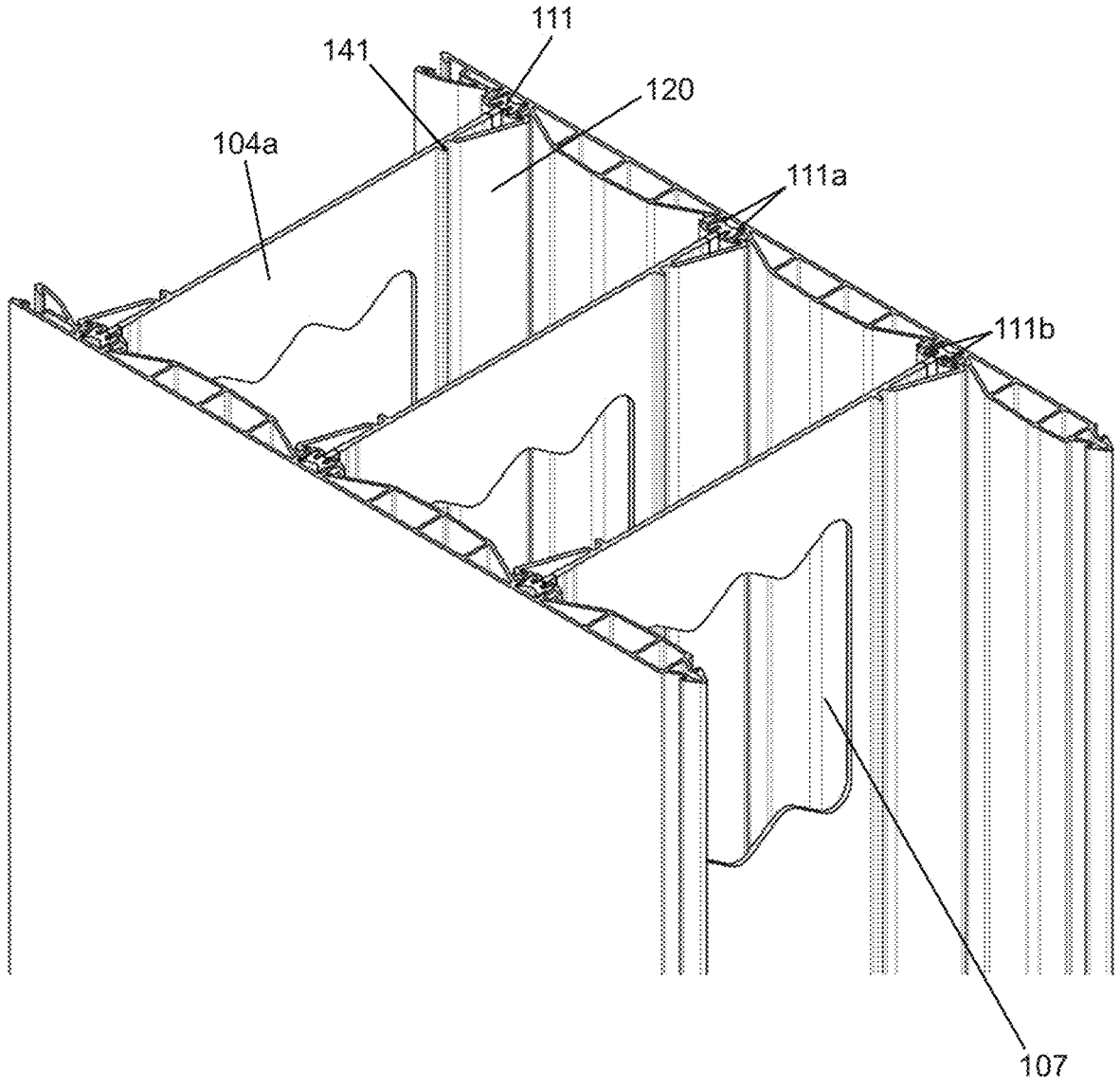
FIG. 21 is an isometric view of the collapsible formwork element as shown in FIG. 14 in the expanded configuration.
Figure 22:
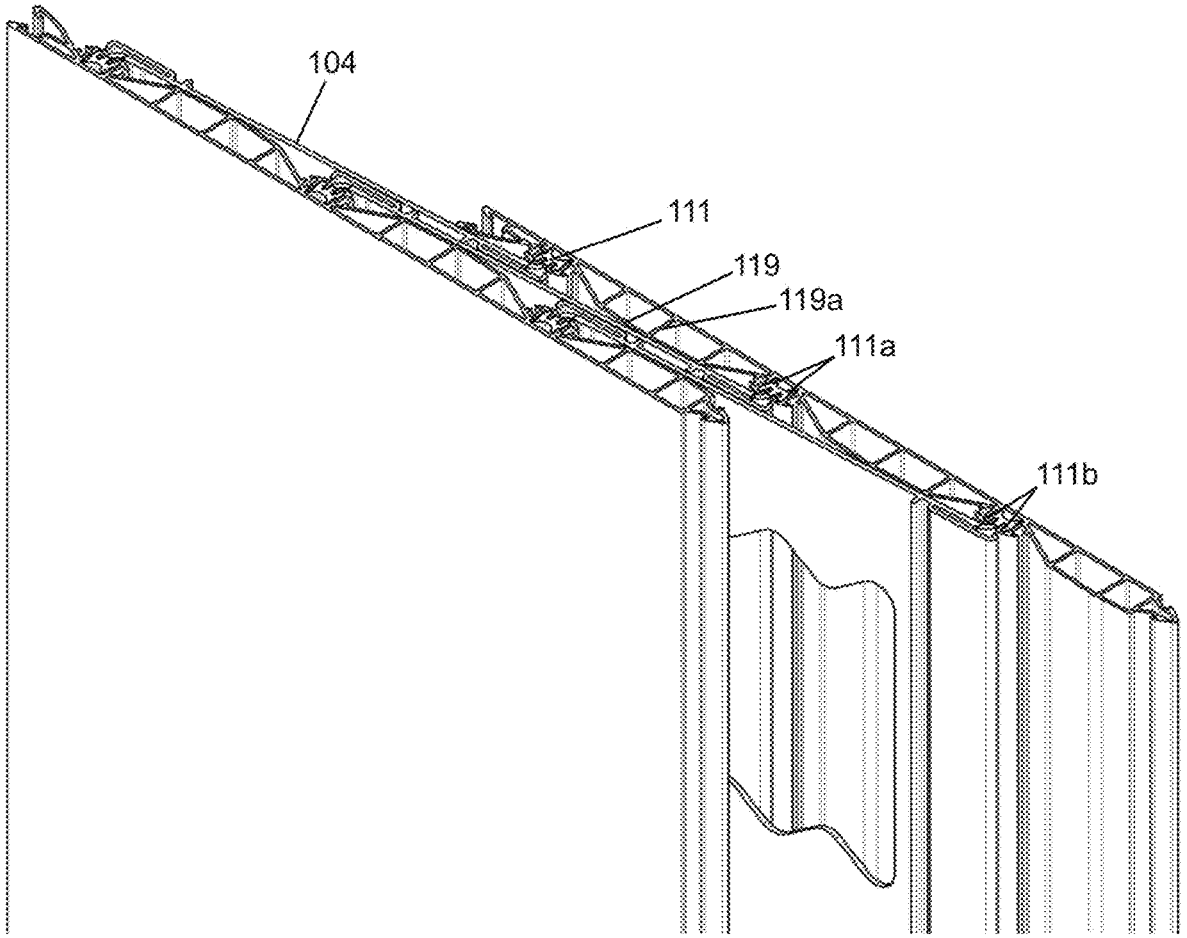
FIG. 22 is an isometric view of the collapsible formwork element as shown in FIG. 15 in the collapsed configuration.
Figure 23:
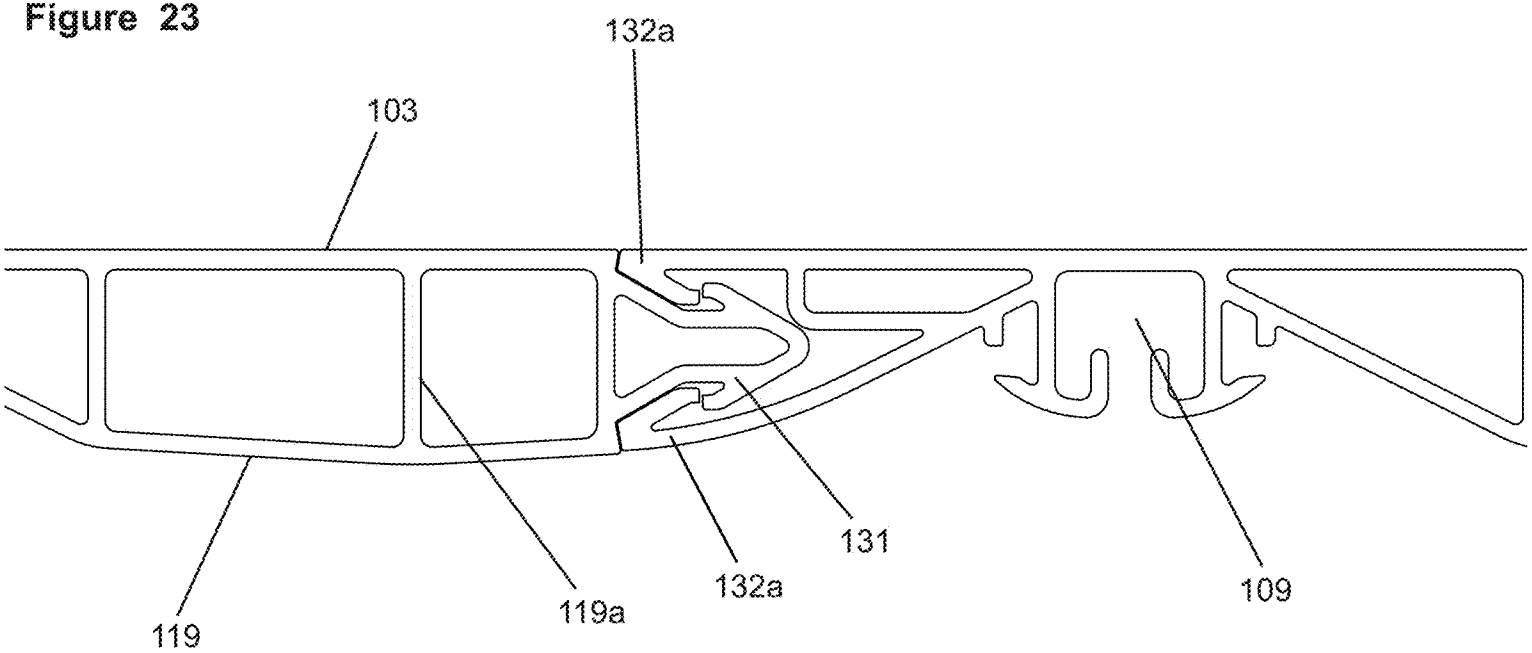
FIG. 23 is a close up top view showing one example of snap engagement between neighbouring formwork elements.
Figure 24:
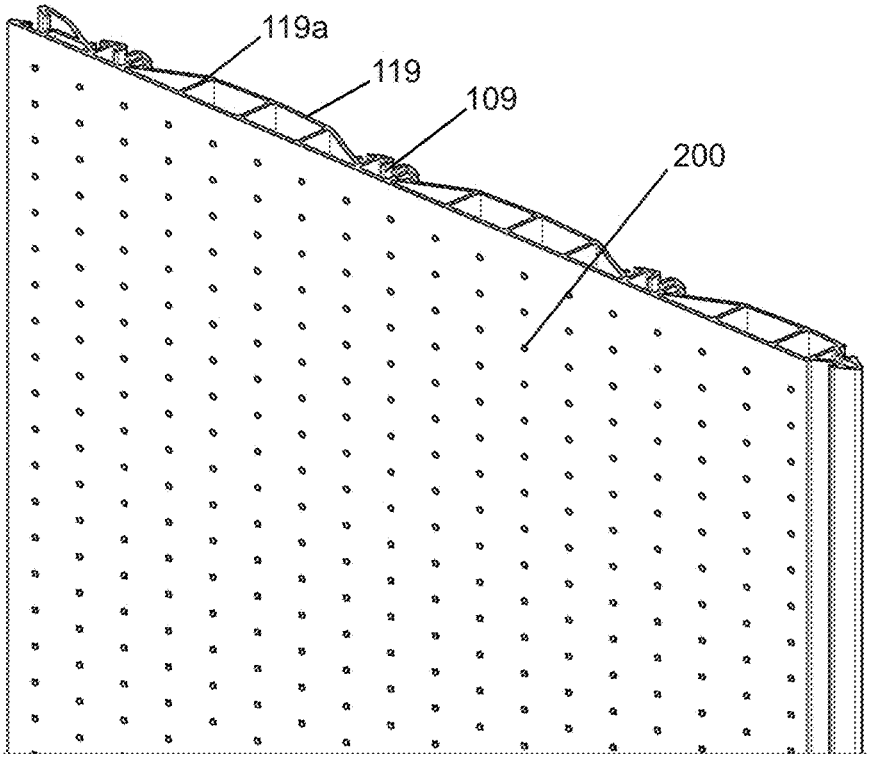
FIG. 24 is an isometric view of one example of a side wall panel with holes in the outer surface.

In the connectors (104) of the element (100), the hinge portions (106) are not generally provided by a thinning in the panel/web (104*a*), although in some forms, they may be (see for example FIG. 18). Typically, the hinge portions (106) in the element (100) are provided by incorporating a second more flexible material at the hinge portion. Whist the majority of the connector member (104) is formed of a substantially rigid material (e.g. PVC), the hinge portions (106) are provided by a relatively more flexible material to allow the hinge type action or bending. Generally, the second more flexible material is incorporated by using co-extrusion. Furthermore the apertures (107) of the panels/webs are more rectangular in nature, with a vary periphery when compared to rounder apertures (7) of connector member (4) from element (1).

An alternate connection means, for connection between like elements is also illustrated in FIGS. 14 to 25. As shown, the element (100) includes engagement portions (131, 132) at the lateral ends of the side wall panels (102, 103). At one lateral end, the side wall panels (102, 103) include slots (132), whilst at the other end, the panels (2, 3) include projections (131) having an arrow shaped cross section (transverse to the plane of the panel). The projections (131) of one element being configured for snap lock insertion into the slots (132) of a neighbouring element (and vice versa). During connection, the arrow head type projections (131) are forced into the slots, the angled heads thereof temporarily separating the walls (132*a*) of the slots, before they snap back around the arrow head projections.

The catch projections (121) configured to snap engage with the hook tabs (120) (to provide snap locking in the expanded configuration) are also modified in formwork element (100) when compared with element (1). In the formwork element (100) the catch projections (121) are supplemented by a supporting or clamping projection (122) to engage the hook tab (100) from the opposite side as it is inserted.

It will be appreciated that the collapsible formwork elements as described herein provide several advantages over conventional formwork elements. In particular, they can be collapsed to fractions of their expanded size (e.g. down to ⅓, ¼, ⅕ or 1/10 expanded size) allowing for space saving during transport and on site. Furthermore, their components can be manufactured as separate parts, and using cost effective extrusion machinery rather than injection moulding.

Typically, the components of the formwork element as described herein are formed of only extruded materials. In one example, the formwork element may expand from a collapsed configuration to an expanded configuration position which is up to 6 times larger, in one action. The elements as described herein are also generally automatically mechanically maintained in the expanded configuration on expansion, wherein the connector member panels/webs are fixed perpendicular (at 90 degrees) to the side wall panels without any additional fasteners, inserts or bracing.

In addition, snap lock connection between elements makes for quick and easy construction of larger formwork structures. The material of the components, which is typically a polymer such as polypropylene or PVC, allows the use of glues/adhesive which can be applied to create high strength joins to accessories or add on components such as floor tracks, window heads, corners, stops ends etc.

It will also be appreciated that various aspects of the formwork elements may be modified. For example, the expanded width may be adjusted by selecting wider connector members. Similarly, the opposing side wall panels may vary in size. Thus the overall size/dimensions of the formwork element may be configured/selected as required.

Optional embodiments of the present invention may also be said to broadly consist in the parts and features referred to or indicated herein, individually or collectively, in any or all combinations of two or more of the parts or features, and wherein specific integers are mentioned herein which have known equivalents in the art to which the invention relates, such known equivalents are deemed to be incorporated herein as if individually set forth.

Although preferred embodiments have been described in detail, it should be understood that various changes, substitutions, and alterations can be made by one of ordinary skill in the art without departing from the scope of the present invention. It will also be appreciated that various forms of the invention may be used individually or in combination.

What is claimed is:

1. A collapsible formwork element, the element including:

a pair of opposing side wall panels; and at least one connector extending between the side wall panels, wherein the at least one connector includes at least two hinge portions that permit movement of the element between an expanded configuration, wherein the opposing panels are spaced apart, and a collapsed configuration, wherein the opposing panels are relatively closer together, and wherein the hinge portions are formed of a material that is more flexible than the material forming the remainder of the connector, which is substantially rigid, so as to provide a hinge type action.

2. A collapsible formwork element as claimed in claim 1, wherein the at least one connector includes a center panel between a pair of hinged ends provided by the hinge portions.

3. A collapsible formwork element claimed in claim 2, wherein the hinged ends are configured to be engaged with the side wall panels.

4. A collapsible formwork element as claimed in claim 1, wherein the at least one connector is produced via co-extrusion, with a first extrusion material forming the hinge portions and a second extrusion material forming the remainder of the connector.

5. A collapsible formwork element as claimed in claim 1, wherein the at least one connector is releasably attachable between the opposing side panels.

6. A collapsible formwork element as claimed in claim 3, wherein the opposing side wall panels include slots therein to respectively receive the hinged ends of the least one connector via a sliding engagement.

7. A collapsible formwork element as claimed in claim 2, wherein, in the expanded configuration, the center panel of the at least one connector extends substantially perpendicular to the opposing side wall panels.

8. A collapsible formwork element as claimed in claim 1, wherein the formwork element includes a plurality of connectors.

9. A collapsible formwork element as claimed in claim 1, wherein the formwork element is configured to snap lock into the expanded configuration.

10. A collapsible formwork element as claimed in claim 9, wherein snap locking is provided via a hook tab that extends from the at least one connector member and is configured to engage a corresponding catch projection on one of the opposing side wall members as the formwork element moves into the expanded configuration.

11. A collapsible formwork element as claimed in claim 1, wherein the side wall panels include one or more channels therein extending substantially vertically therethrough.

12. A collapsible formwork element as claimed in claim 1, wherein the lateral ends of the opposing side wall panels include engagement portions for engagement with like collapsible formwork elements so as to allow formation of a formwork structure comprised of a plurality of the collapsible formwork elements.

13. A collapsible formwork element as claimed in claim 12, wherein the engagement portions are configured to provide snap lock engagement between neighbouring formwork elements.

14. A collapsible formwork element as claimed in claim 1, wherein the at least one connector member and side wall panels are each separately formed as single extruded pieces.

15. A collapsible formwork element as claimed in claim 1, wherein the at least one connector and the opposing side wall panels are together integrally formed as a unitary piece.

16. A collapsible formwork element, the element including:

a pair of opposing side wall panels; and at least one connector extending between the side wall panels, wherein the at least one connector includes at least two hinge portions that permit movement of the element between an expanded configuration, wherein the opposing panels are spaced apart, and a collapsed configuration, wherein the opposing panels are relatively closer together, and wherein the at least one connector is produced via co-extrusion, with a first extrusion material forming the hinge portions and a second extrusion material forming the remainder of the connector member.

17. A collapsible formwork element as claimed in claim 16, wherein the at least one connector and the opposing side wall panels are together integrally formed as a unitary piece.

18. A collapsible formwork element, the element including:

a pair of opposing side wall panels; and at least one connector extending between the side wall panels, wherein the at least one connector includes at least two hinge portions that permit movement of the element between an expanded configuration, wherein the opposing panels are spaced apart, and a collapsed configuration, wherein the opposing panels are relatively closer together, wherein the formwork element is configured to snap lock into the expanded configuration, and wherein snap locking is provided via a hook tab that extends from the at least one connector and is configured to engage a corresponding catch projection on one of the opposing side wall members as the formwork element moves into the expanded configuration.

19. A collapsible formwork element as claimed in claim 18, wherein the at least one connector and the opposing side wall panels are together integrally formed as a unitary piece.

20. A collapsible formwork element as claimed in claim 18, wherein the hinge portions make a hinged connection with the side wall panels.

* * * * *